US010760143B2

(12) United States Patent
Okubo et al.

(10) Patent No.: US 10,760,143 B2
(45) Date of Patent: Sep. 1, 2020

(54) HIGH-SILICON STEEL SHEET AND METHOD OF MANUFACTURING THE SAME

(71) Applicant: JFE Steel Corporation, Tokyo (JP)

(72) Inventors: Tomoyuki Okubo, Tokyo (JP); Tatsuhiko Hiratani, Tokyo (JP); Yoshihiko Oda, Tokyo (JP); Hiroaki Nakajima, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 267 days.

(21) Appl. No.: 15/758,826

(22) PCT Filed: Sep. 8, 2016

(86) PCT No.: PCT/JP2016/004091

§ 371 (c)(1),
(2) Date: Mar. 9, 2018

(87) PCT Pub. No.: WO2017/047049

PCT Pub. Date: Mar. 23, 2017

(65) Prior Publication Data

US 2018/0340239 A1 Nov. 29, 2018

(30) Foreign Application Priority Data

Sep. 17, 2015 (JP) ..... 2015-183502

(51) Int. Cl.
*C21D 9/46* (2006.01)
*C22C 38/06* (2006.01)
(Continued)

(52) U.S. Cl.
CPC ..... *C21D 9/46* (2013.01); *B21B 1/22* (2013.01); *B21B 1/222* (2013.01); *B21B 1/227* (2013.01);
(Continued)

(58) Field of Classification Search
CPC ..... C21D 9/46; C21D 8/1222; C21D 8/1233; C21D 8/1266
See application file for complete search history.

(56) References Cited

U.S. PATENT DOCUMENTS 6,562,473 B1 * 5/2003 Okabe ..... C21D 8/12 148/100
2007/0125450 A1 * 6/2007 Lin ..... C22C 38/02 148/111
(Continued)

FOREIGN PATENT DOCUMENTS

CN 1089663 A 7/1994
CN 102534157 A 7/2012
(Continued)

OTHER PUBLICATIONS

Extended European Search Report dated Jun. 22, 2018, of counterpart European Application No. 16845924.6.
(Continued)

*Primary Examiner* — Scott R Kastler
(74) *Attorney, Agent, or Firm* — DLA Piper LLP (US)

(57) ABSTRACT

A high-silicon steel sheet is excellent in terms of punching workability and magnetic property. The high-silicon steel sheet has a chemical composition containing, by mass %, C: 0.02% or less, P: 0.02% or less, Si: 4.5% or more and 7.0% or less, Mn: 0.01% or more and 1.0% or less, Al: 1.0% or less, O: 0.01% or less, N: 0.01% or less, and the balance being Fe and inevitable impurities, a grain-boundary oxygen concentration (oxygen concentration with respect to chemical elements segregated at grain boundaries) of 30 at % or less, and a microstructure in which a degree of integration P(211) of a {211}-plane of α-Fe on a surface of the steel sheet is 15% or more $P(211)=p(211)/S\times100(\%)$, wherein
(Continued)

$S=p(110)/100+p(200)/14.93+p(211)/25.88+p(310)/7.68+p(222)/1.59+p(321)/6.27+p(411)/1.55$, and p(hkl): integrated intensity of a peak of X-ray diffraction of an {hkl}-plane.

20 Claims, 1 Drawing Sheet

(51) Int. Cl.

| | |
|---|---|
| ***C22C 38/02*** | (2006.01) |
| ***C22C 38/04*** | (2006.01) |
| ***B21B 3/02*** | (2006.01) |
| ***C22C 38/00*** | (2006.01) |
| ***C21D 8/12*** | (2006.01) |
| ***C23C 10/08*** | (2006.01) |
| ***B21B 1/22*** | (2006.01) |
| ***C21D 6/00*** | (2006.01) |
| *C22C 38/60* | (2006.01) |

(52) U.S. Cl.

CPC ..... *B21B 3/02* (2013.01); *C21D 6/008* (2013.01); *C21D 8/12* (2013.01); *C21D 8/1222* (2013.01); *C21D 8/1233* (2013.01); *C21D 8/1266* (2013.01); *C21D 8/1272* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C23C 10/08* (2013.01); *C22C 38/60* (2013.01)

(56) References Cited

U.S. PATENT DOCUMENTS

| | | | | |
|---|---|---|---|---|
| 2014/0255720 | A1 | 9/2014 | Imamura et al. | |
| 2016/0319387 | A1* | 11/2016 | Kim | B21B 3/00 |
| 2018/0340239 | A1* | 11/2018 | Okubo | B21B 1/22 |

FOREIGN PATENT DOCUMENTS

| | | | |
|---|---|---|---|
| CN | 104073714 | A | 10/2014 |
| EP | 0601549 | A1 | 6/1994 |
| EP | 1 249 513 | A1 | 10/2002 |
| JP | S62-69501 | A | 3/1987 |
| JP | 62-263827 | A | 11/1987 |
| JP | S63-277715 | A | 11/1988 |
| JP | 6-172940 | A | 6/1994 |
| JP | 6-192797 | A | 7/1994 |
| JP | 6-220590 | A | 8/1994 |
| JP | H06-212397 | A | 8/1994 |
| JP | 2003-113453 | A | 4/2003 |
| JP | 2005-281737 | A | 10/2005 |
| JP | 2009-228117 | A | 10/2009 |
| JP | 2016-169423 | A | 9/2016 |
| TW | 528622 | | 4/2003 |
| TW | 201034769 | A | 10/2010 |

OTHER PUBLICATIONS

Office Action dated Jul. 26, 2017, of counterpart Taiwanese Application No. 105129821, along with a Search Report in English.

Office Action dated Mar. 5, 2019, of counterpart Canadian Application No. 2,992,966.

Korean Notice of Allowance dated Jul. 16, 2019, of counterpart Korean Application No. 10-2018-7007200, along with an English translation.

Office Action dated Feb. 15, 2019, of counterpart Chinese Application No. 201680053656.7, along with a Search Report in English.

Zhongzhi, H.E. et al., "Electrical Steel", *Metallurgical Industry Press*, Sep. 30, 2012, pp. 618-619, along with an English translation.

Korean Office Action dated Apr. 12, 2019, of counterpart Korean Application No. 2018-7007200, along with a Concise Statement of Relevance of Office Action in English.

* cited by examiner

HIGH-SILICON STEEL SHEET AND METHOD OF MANUFACTURING THE SAME

TECHNICAL FIELD

This disclosure relates to a high-silicon steel sheet used as a material for, for example, iron cores of transformers and motors and to a method of manufacturing the steel sheet.

BACKGROUND

A silicon steel sheet having excellent magnetic properties is widely used as a material for, for example, iron cores of transformers and motors. In addition, from the viewpoint of magnetic property (iron loss), it is preferable that a high-silicon steel sheet be used because the iron loss of a silicon steel sheet decreases with an increase in Si content.

Since the toughness of steel decreases with an increase in Si content, it is difficult to manufacture a thin steel sheet by using a commonly used rolling method. However, since a method of manufacturing a high-silicon steel sheet having a silicon content of about 6.5 mass % by using a gas-phase siliconizing method has been developed, mass production of a high-silicon steel sheet is possible on an industrial scale nowadays.

When a high-silicon steel sheet is used as parts of, for example, transformers and motors, it is necessary to perform punching work. However, since cracking tends to occur due to the brittleness of a high-silicon steel sheet, when punching work is performed, it is necessary to perform punching work in a warm temperature range, as stated in Japanese Unexamined Patent Application Publication No. 62-263827, or under a strictly controlled processing condition regarding, for example, mold clearance.

However, to perform warm working, it is necessary to use a pressing machine having a heating device, and an expensive high-precision mold is indispensable because it is necessary to design a mold in consideration of thermal expansion.

In addition, although it is possible to perform punching work at room temperature if clearance is controlled to be much smaller than that in an ordinary electrical steel sheet, there is a problem in that, for example, chipping tends to occur due to severe wear damage on the mold in this case. In addition, since clearance increases with an increase in the number of punching operations, there is a problem of an increase in the frequency of changing a mold.

It could therefore be helpful to provide a high-silicon steel sheet excellent in terms of punching workability and magnetic property.

SUMMARY

We found that it is possible to achieve good punching workability by controlling the oxygen concentration with respect to chemical elements segregated at grain boundaries, that is, grain-boundary oxygen concentration (hereinafter, also referred to as "grain-boundary oxygen content"), and by controlling the texture.

We thus provide:

[1] A high-silicon steel sheet having a chemical composition containing, by mass %, C: 0.02% or less, P: 0.02% or less, Si: 4.5% or more and 7.0% or less, Mn: 0.01% or more and 1.0% or less, Al: 1.0% or less, O: 0.01% or less, N: 0.01% or less, and the balance being Fe and inevitable impurities, a grain-boundary oxygen concentration (oxygen concentration with respect to chemical elements segregated at grain boundaries) of 30 at % or less, and a microstructure in which a degree of integration P(211) of a {211}-plane of α-Fe on a surface of the steel sheet is 15% or more.

The degree of integration P(hkl) of each crystal plane is defined by the equation below on the basis of integrated intensities of various peaks obtained by using an X-ray diffraction method:

$$P(211)=p(211)/S\times 100(\%),\text{ where}$$

$$S=p(110)/100+p(200)/14.93+p(211)/25.88+p(310)/7.68+p(222)/1.59+p(321)/6.2'7+p(411)/1.55,\text{ and where}$$

p(hkl): integrated intensity of a peak of X-ray diffraction of an {hkl}-plane.

[2] The high-silicon steel sheet according to item [1] above, the steel sheet having the chemical composition further containing, by mass %, S: 0.010% or less.

[3] The high-silicon steel sheet according to item [1] or [2] above, in which the degree of integration P(211) is 20% or more.

[4] The high-silicon steel sheet according to any one of items [1] to [3] above, in which a difference in Si concentration ΔSi between a surface layer of the steel sheet and a central portion in a thickness direction of the steel sheet is 0.1% or more.

[5] A method of manufacturing a high-silicon steel sheet according to any one of items [1], [3], and [4] above, the method including performing hot rolling on a steel slab having a chemical composition containing, by mass %, C: 0.02% or less, P: 0.02% or less, Si: 5.5% or less, Mn: 0.01% or more and 1.0% or less, Al: 1.0% or less, O: 0.01% or less, N: 0.01% or less, and the balance being Fe and inevitable impurities, optionally performing hot-rolled-sheet annealing, performing cold rolling once, or more than once with process annealing interposed between periods in which cold rolling is performed under a condition that at least one pass of final cold rolling is performed with rolls having an Ra of 0.5 μm or less, and performing finish annealing which includes a gas-phase siliconizing treatment.

[6] The method of manufacturing a high-silicon steel sheet according to item [5] above, the steel slab having the chemical composition further containing, by mass %, S: 0.010% or less.

[7] The method of manufacturing a high-silicon steel sheet according to item [5] or [6] above, in which an aging treatment is performed at least once between passes of the final cold rolling at a temperature of 50° C. or higher for 5 minutes or more.

"%" used when describing the constituent chemical elements of steel refers to "mass %", unless otherwise noted.

It is possible to provide a high-silicon steel sheet excellent in terms of punching workability and magnetic property. It is not necessary to use an expensive high-precision mold. It is also possible to address the tendency for, for example, chipping to occur due to severe wear damage on a mold. Therefore, the steel sheet can preferably be used as a material for iron cores of transformers and motors.

DETAILED DESCRIPTION

Hereafter, our steel sheets and methods will be described in detail. The steel sheets and methods will be described in detail on the basis of experimental results.

Figure 1:
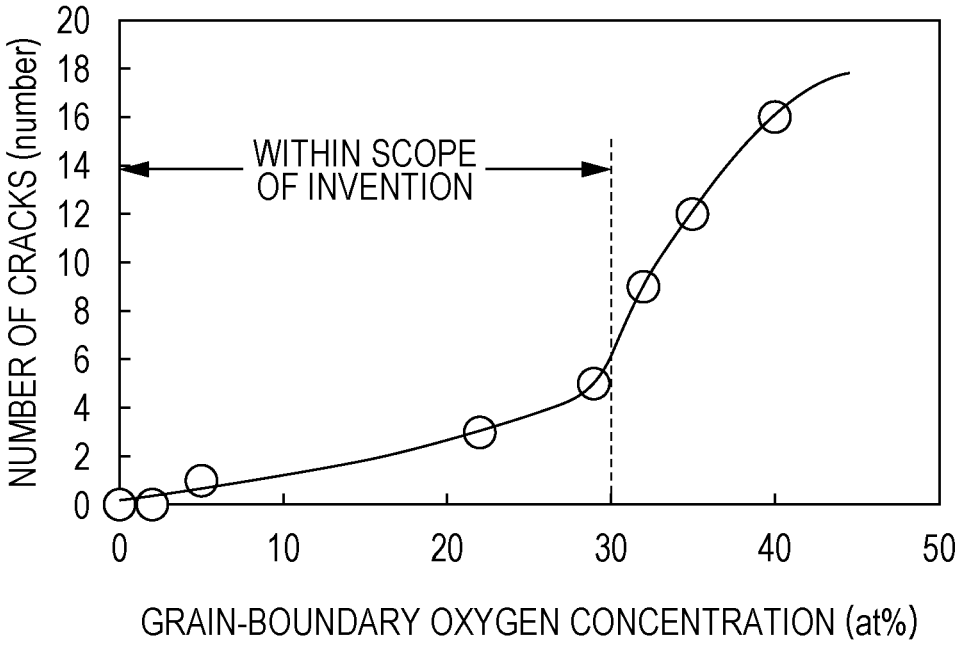
FIG. 1 is a diagram illustrating the relationship between the grain-boundary oxygen concentration and the number of cracks.

First, to investigate the influence of the grain-boundary oxygen concentration on cracking when punching work is performed, the following experiment was conducted. Steel containing C: 0.0032%, Si: 3.2%, Mn: 0.13%, P: 0.01%, Al: 0.001%, O=0.0017%, N=0.0018%, S=0.0020% was melted in a laboratory and hot-rolled to a thickness of 1.5 mm. Subsequently, this hot-rolled steel sheet was subjected to hot-rolled-sheet annealing at a temperature of 920° C. for 60 seconds, pickling, and cold rolling to a thickness of 0.10 mm with rolls having an Ra of 0.2 μm. Subsequently, by performing finish annealing at a temperature of 1200° C. for 10 minutes in a gas containing silicon tetrachloride to achieve a Si concentration of 6.49% after finish annealing has been performed, a high-silicon steel sheet having a homogeneous Si concentration was manufactured. The dew point was varied from 0° C. to −40° C. when finish annealing was performed to vary the grain-boundary oxygen concentration. By performing punching work at room temperature on a rectangular sample of 50 mm×30 mm taken from each of the high-silicon steel sheets obtained as described above, the relationship between cracking and the grain-boundary oxygen concentration of each of the high-silicon steel sheets was investigated. The punching workability of each of the steel sheets was evaluated on the basis of the number of cracks generated by observing shear planes by using a microscope at a magnification of 50 times. The number of cracks generated (hereinafter, referred to as "number of cracks") was defined as the number of cracks observed when the test was performed on the shear planes (four shear planes) on the four sides of the rectangular sample of 50 mm×30 mm described above by using a microscope. The grain-boundary oxygen concentration was determined by using an Auger electron spectrometer. In the observation using this spectrometer, since Auger electrons are diffracted while clean grain-boundary fracture surfaces, which are not contaminated by atmospheric air, are observed by fracturing the sample in a vacuum vessel whose vacuum degree is maintained to be $10^{-7}$ Pa or lower, it is possible to analyze chemical elements on clean grain-boundary fracture surfaces. The results obtained as described above are illustrated in FIG. 1. FIG. 1 shows that there is a significant decrease in the number of cracks when punching work is performed by controlling the grain-boundary oxygen concentration to be 30 at % or less.

To investigate the reason for this, we observed fracture surfaces generated when punching work was performed. As a result, many intra-grain cracks were observed in a material having a low grain-boundary oxygen content, and many grain-boundary cracks were observed in a material having a high grain-boundary oxygen content. Therefore, we believe that, since grain-boundary strength decreases with an increase in grain-boundary oxygen content, there is an increased tendency for the grain-boundary cracking to occur, which results in an increased tendency for cracking to occur when punching work is performed.

Therefore, grain-boundary oxygen concentration (grain-boundary oxygen content) is 30 at % or less, preferably 20 at % or less, or more preferably 10 at % or less.

It is possible to control the grain-boundary oxygen concentration (grain-boundary oxygen content) by performing a vacuum heat treatment in which the vacuum degree is controlled as a final heating treatment or by controlling the dew point or hydrogen concentration ($H_2$ concentration) in an atmosphere in accordance with an annealing temperature when finish annealing is performed. When a vacuum heat treatment is performed, it is preferable that the pressure be 100 Pa or lower. When finish annealing is performed, it is preferable that the dew point be −20° C. or lower in a non-oxidizing atmosphere or that the hydrogen concentration ($H_2$ concentration) in an atmosphere be 3 vol % or more.

Figure 2:
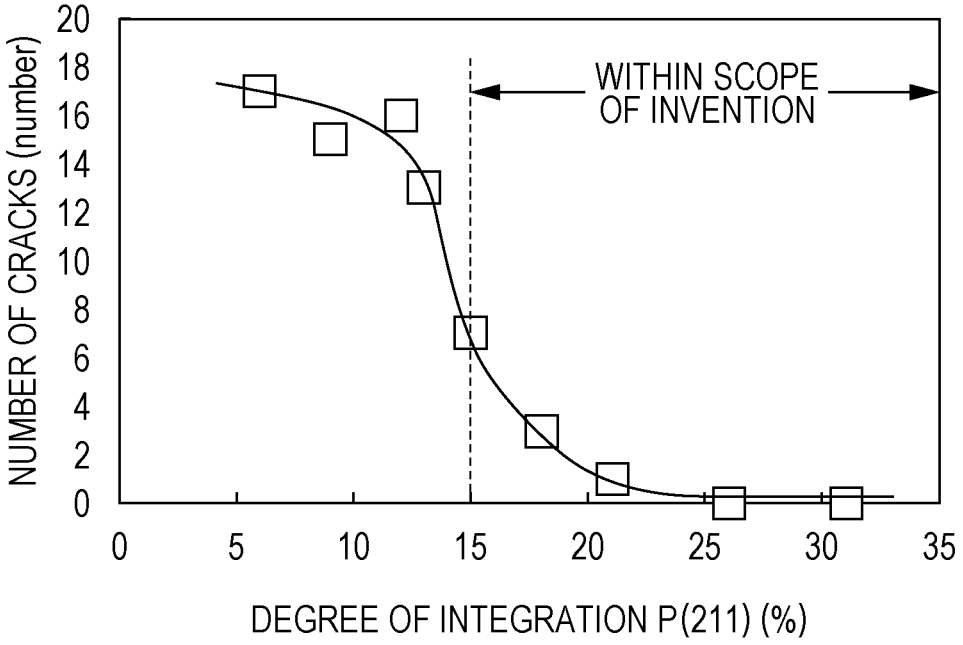
FIG. 2 is a diagram illustrating the relationship between the degree of integration P(211) and the number of cracks.

Subsequently, to investigate the manufacturing stability of a high-silicon steel sheet, steel containing C: 0.0023%, Si: 3.2%, Mn: 0.15%, P: 0.01%, Al=0.001%, O=0.0016%, N=0.0015%, S=0.0015% was melted in a practical manufacturing line and hot-rolled to a thickness of 1.6 mm. Subsequently, this hot-rolled steel sheet was subjected to hot-rolled-sheet annealing at a temperature of 950° C. for 30 seconds, pickling, and cold rolling to a thickness of 0.10 mm under various conditions. Subsequently, by performing finish annealing at a temperature of 1200° C. for 10 minutes in a gas containing silicon tetrachloride to achieve a Si concentration of 6.51% after finish annealing had been performed, a high-silicon steel sheet having a homogeneous Si concentration was manufactured. The dew point was −40° C. By performing punching work at room temperature on a rectangular sample of 50 mm×30 mm taken from each of the high-silicon steel sheets obtained as described above, generation of cracks was investigated. In addition, the grain-boundary oxygen concentration was determined by performing Auger electron spectrometry. As a result, although the grain-boundary oxygen concentration was a low concentration of 10 at %, cracking occurred in some of the samples when punching work was performed. From the results of the investigations regarding the reason for cracking, we clarified that there is a correlation between the texture of a steel sheet, in particular, (211)-plane intensity, and cracking when punching work is performed. FIG. 2 illustrates the relationship between the degree of integration P(211) of the {211}-plane and the number of cracks. FIG. 2 shows that it is possible to inhibit cracking from occurring by controlling the degree of integration P(211) to be 15% or more, preferably 20% or more, or more preferably 25% or more.

The degree of integration P(211) of the {211}-plane is defined by the equation below on the basis of the integrated intensities of various peaks obtained by using an X-ray diffraction method:

$$P(211)=p(211)/S\times 100(\%),\ \text{where}$$

$$S=p(110)/100+p(200)/14.93+p(211)/25.88+p(310)/7.68+p(222)/1.59+p(321)/6.27+p(411)/1.55,\ \text{and where}$$

p(hkl): integrated intensity of the peak of X-ray diffraction of the {hkl}-plane.

Although the mechanism by which cracking is inhibited from occurring when punching work is performed as a result of increasing the degree of integration P(211) is not clear, it is presumed that deformation is confined to a specific slip system as a result of arranging {211} parallel to the surface of a sheet, which has some effect on punching workability.

Therefore, the degree of integration P(211) of the {211}-plane of α-Fe on the surface of a steel sheet is 15% or more, preferably 20% or more, or more preferably 50% or more. Although there is no particular limitation on the upper limit of the degree of integration P(211), it is preferable that the upper limit be 90% or less, because excessive integration of the {211}-plane is not preferable from the viewpoint of magnetic flux density.

It is possible to determine the degree of integration P(211) of the {211}-plane of α-Fe on the surface of a steel sheet by using the following method. The texture is determined in the surface layer of a steel sheet. In addition, in the determination of the texture, seven planes having Miller indices of {110}, {200}, {211}, {310}, {222}, {321}, and {411} are observed by using an X-ray diffraction method with a Mo-Kα ray by using RINT-2200 manufactured by Rigaku Corporation (RINT is a registered trademark). Since the integrated intensity of the diffraction peak of the {411}-plane is observed in the vicinity of a position corresponding to a 2θ value of 63° to 64°, and since this intensity includes the contribution of the {330}-plane, ⅔ of the integrated intensity of this peak is defined as the integrated intensity of the {411}-plane, and ⅓ of the integrated intensity of this peak is defined as the integrated intensity of the {330}-plane. In addition, since the integrated intensity of a peak on the side of a higher angle causes an increase in variability, such intensity is not involved in the evaluation of our steel sheets and methods.

The degree of integration P(211) of the {211}-plane is calculated by using the equation below on the basis of the integrated intensities of the peaks of X-ray diffraction of planes having Miller indices of {110}, {200}, {211}, {310}, {222}, {321}, and {411}:

$$P(211)=p(211)/S\times 100(\%),\text{ where}$$

$$S=p(110)/100+p(200)/14.93+p(211)/25.88+p(310)/7.68+p(222)/1.59+p(321)/6.27+p(411)/1.55,\text{ and where}$$

p(hkl): the integrated intensity of the peak of X-ray diffraction of {hkl}-plane.

The constant by which the integrated intensity p(hkl) of each of the planes is divided corresponded to the integrated intensity of the {hkl}-plane of a random sample and was derived by using numerical computation. It is possible to inhibit cracking from occurring when punching work is performed by controlling P(211) to be 15% or more, or preferably 20% or more.

In addition, we clarified that, to increase the degree of integration of the {211}-plane, it is important to perform at least one pass of the final cold rolling with rolls having an Ra of 0.5 μm or less when cold rolling is performed. This is considered to be because decreasing shear strain which is applied when cold rolling is performed has an effect on the nucleation of recrystallized grains.

Hereafter, the chemical composition of the high-silicon steel sheet will be described.

C: 0.02% or less

Since there is an increase in iron loss due to magnetic aging when the C content is more than 0.02%, the C content is 0.02% or less. Decarburization may occur during the manufacturing process, and it is preferable that the C content be 0.005% or less.

P: 0.02% or less

Since cracking occurs due to significant embrittlement of steel when the P content is more than 0.02%, the P content is 0.02% or less, or preferably 0.01% or less.

Si: 4.5% or more and 7.0% or less

Si is a chemical element effective to decrease the degree of magnetostriction by increasing specific resistance. The Si content is 4.5% or more to realize such an effect. Although it is possible to easily form a Si concentration gradient in the thickness direction by performing a gas-phase siliconizing treatment, the average Si content in the thickness direction is 4.5% or more also in this case. On the other hand, when the Si content is more than 7.0%, cracking tends to occur, and there is a significant decrease in saturated magnetic flux density. Therefore, the Si content is 4.5% or more and 7.0% or less.

Mn: 0.01% or more and 1.0% or less

Since Mn improves hot workability, it is necessary that the Mn content be 0.01% or more. On the other hand, when the Mn content is more than 1.0%, there is a decrease in saturated magnetic flux density. Therefore, the Mn content is 0.01% or more and 1.0% or less.

Al: 1.0% or less

Since Al is a chemical element that decreases iron loss by decreasing the amount of fine AlN, Al may be added. However, when the Al content is more than 1.0%, there is a significant decrease in saturated magnetic flux density. Therefore, the Al content is 1.0% or less. Since Al is also a chemical element that increases the degree of magnetostriction, it is preferable that the Al content be 0.01% or less.

O: 0.01% or less

O deteriorates the workability of a high-silicon steel sheet when the O content is more than 0.01%. Therefore, the upper limit of the O content is 0.01%. The O content specified here is the total content of 0 existing inside grains and at grain boundaries. It is preferable that the O content be 0.010% or less, or more preferably 0.004% or less.

N: 0.01% or less

N increases iron loss due to the precipitation of nitrides when the N content is more than 0.01%. Therefore, the upper limit of the N content is 0.01%, preferably 0.010% or less, or more preferably 0.004% or less.

The remainder is Fe and inevitable impurities.

Although it is possible to realize the desired effects with the chemical composition described above, the chemical elements below may be added to further improve manufacturability or material properties.

One or both of Sn and Sb: 0.001% or more and 0.2% or less in total

Sn and Sb are chemical elements that improve iron loss by preventing nitriding and are effectively added from the viewpoint of increasing magnetic flux density through the control of texture. It is preferable that the total content of one or both of Sn and Sb be 0.001% or more to realize such effects. On the other hand, when the total content is more than 0.2%, such effects become saturated. In addition, Sb is also a chemical element tending to be segregated at grain boundaries. It is preferable that the upper limit of the total content of one or both of Sn and Sb be 0.2% from the viewpoint of preventing cracking from occurring when punching work is performed.

One or both of Cr and Ni: 0.05% or more and 1.0% or less in total

Cr and Ni are chemical elements that increase specific resistance and thereby improve iron loss. It is possible to realize such effects when the total content of one or both of Cr and Ni is 0.05% or more. On the other hand, when the total content of one or both of Cr and Ni is more than 1.0%, there is an increase in cost. Therefore, it is preferable that the total content of one or both of Cr and Ni be 0.05% or more and 1.0% or less.

One, two, or all of Ca, Mg, and REM: 0.0005% or more and 0.01% or less in total

Ca, Mg, and REM are chemical elements that decrease iron loss by decreasing the amounts of fine sulfides. It is possible to realize such an effect when the total content of one, two, or all of Ca, Mg, and REM is 0.0005% or more, and there is conversely an increase in iron loss when the total content is more than 0.01%. Therefore, it is preferable that the total content of one, two, or all of Ca, Mg, and REM be 0.0005% or more and 0.01% or less.

S: 0.010% or less

S is a grain-boundary segregation-type chemical element. There is an increase in the occurrence frequency of cracking when the S content is more than 0.010%. Therefore, the S content is 0.010% or less.

Hereafter, the method of manufacturing the high-silicon steel sheet will be described.

In the method of manufacturing the high-silicon steel sheet, molten steel having the above-described chemical composition is prepared by using a known melting furnace such as a converter or an electric furnace and, optionally, further subjected to secondary refining by using, for example, a ladle-refining method or a vacuum refining method, and the molten steel is made into a steel piece (slab) by using a continuous casting method or an ingot casting-slabbing method. Subsequently, the steel sheet can be manufactured by performing processes such as hot rolling, hot-rolled-sheet annealing (as needed), pickling, cold rolling, finish annealing, and pickling on the slab. The cold rolling described above may be performed once, or more than once with process annealing interposed between the periods in which cold rolling is performed, and each of a cold rolling process, a finish annealing process, and a pickling process may be repeated. Moreover, hot-rolled-sheet annealing, that increases the tendency for cracking of a steel sheet to occur when cold rolling is performed while being effective to improve magnetic flux density, may be omitted. In addition, finish annealing including a gas-phase siliconizing treatment is performed after cold rolling has been performed, and the gas-phase siliconizing treatment may be performed by using a known method. For example, it is preferable to first perform a siliconizing treatment in a non-oxidizing atmosphere containing 5 mol % to 35 mol % of $SiCl_4$ at a temperature of 1000° C. to 1250° C. for 0.1 minutes to 30 minutes followed by a diffusion treatment (homogenization treatment) in a non-oxidizing atmosphere without $SiCl_4$ at a temperature of 1100° C. to 1250° C. for 1 minute to 30 minutes. It is possible to form a Si concentration gradient in the thickness direction by controlling the diffusion time and diffusion temperature or by omitting the diffusion treatment.

In the method described above, at least one pass of the final cold rolling is performed with rolls having an Ra (arithmetic average roughness) of 0.5 μm or less. In addition, it is preferable that an aging treatment be performed at least once between the passes of the final cold rolling at a temperature of 50° C. or higher for 5 minutes or more.

By performing at least one pass of cold rolling with rolls having an Ra of 0.5 μm or less, it is possible to control the texture of a high-silicon steel sheet so that the degree of integration P(211) of the {211}-plane of α-Fe on the surface of the steel sheet is 15% or more. When the texture is further controlled so that P(211) is 20% or more, it is preferable that an aging treatment be performed at least once between the passes of the final cold rolling at a temperature of 50° C. or higher for 5 minutes or more. In addition, it is preferable that the upper limit of the aging treatment time be 100 minutes from the viewpoint of productivity.

It is possible to inhibit cracking from occurring when punching work is performed by inhibiting the grain-boundary oxidation of steel in finish annealing. It is preferable to use, for example, a method in which the dew point is controlled to be −20° C. or lower or a method in which the $H_2$ concentration of the atmosphere is controlled to be 3 vol % or more.

It is preferable that the crystal grain size after finish annealing has been performed is 3 times or less the steel sheet thickness because there is a deterioration in workability when the crystal grain size after finish annealing has been performed is excessively large. It is possible to control the crystal grain size to be 3 times or less the steel sheet thickness by performing finish annealing without allowing abnormal grain growth (secondary recrystallization) to occur. After finish annealing has been performed, insulating coating may be applied as needed, and known organic, inorganic, or organic-inorganic hybrid coating may be used in accordance with the purpose.

By using the method described above, it is possible to obtain the high-silicon steel sheet. The high-silicon steel sheet has a grain-boundary oxygen concentration (oxygen concentration with respect to chemical elements segregated at grain boundaries) of 30 at % or less and a microstructure in which the degree of integration P(211) of the {211}-plane of α-Fe on the surface of the steel sheet is 15% or more.

Moreover, it is preferable that the difference in Si concentration ΔSi between the surface layer of the steel sheet and the central portion in the thickness direction of the steel sheet be 0.1% or more. Controlling ΔSi to be 0.1% or more is effective to further decrease high-frequency iron loss after having realized the desired effects. That is, by controlling the difference in Si concentration ΔSi between the surface layer and the central portion to be 0.1% or more, it is possible to decrease high-frequency iron loss. There is no particular limitation on the upper limit of ΔSi. However, it is preferable that the Si content in the surface layer be 7.0% or less because there is a deterioration in iron loss when the Si content in the surface layer is 7.0% or more. From this viewpoint, it is preferable that ΔSi be 4.0% or less. It is more preferable that ΔSi be 1.0% or more and 4.0% or less from the viewpoint of decreasing high-frequency iron loss and siliconizing costs. It is possible to determine ΔSi by analyzing a Si profile in the depth direction of the thickness cross section of a steel sheet by using an EPMA. The term "surface layer" denotes a region from the surface of a steel sheet to a position located at 1/20 of the thickness in the direction towards the central portion in the thickness direction.

Example 1

Hereafter, our steel sheets and methods will be described in detail on the basis of examples.

Steel slabs having the chemical compositions given in Table 1 were hot-rolled to a thickness of 1.6 mm. Subsequently, the hot-rolled steel sheets were subjected to hot-rolled-sheet annealing at a temperature of 960° C. for 20 seconds, pickling, cold-rolling to a thickness of 0.10 mm, and finish annealing. Some of the steels were subjected to an aging treatment before rolling was performed by using a Sendzimir rolling mill.

In the process described above, after cold rolling had been performed to a thickness of 0.60 mm through 5 passes by using a tandem rolling mill equipped with rolls having an Ra of 0.6 μm, cold rolling was performed to a thickness of 0.10 mm through 8 passes by using a Sendzimir rolling mill installed with rolls having the various values of Ra given in Table 1.

In addition, in finish annealing, after a gas-phase siliconizing treatment had been performed at a temperature of 1200° C. for 5 minutes in a gas containing silicon tetrachloride, a diffusion treatment was further performed at a temperature of 1200° C. for a maximum of 5 minutes to obtain the product chemical compositions given in Table 1 characterized by average Si content and ΔSi. The dew point was controlled to be 0° C. to −40° C. when a gas-phase siliconizing treatment was performed to vary grain-boundary oxygen concentration.

Punching work at room temperature was performed on rectangular samples of 50 mm×30 mm taken from the high-silicon steel sheets obtained as described above. The clearance of the mold was 5% of the thickness of the steel sheets.

The grain-boundary oxygen concentration (grain-boundary oxygen content) and the degree of integration P(211) of the {211}-plane of α-Fe were determined for the sample of each of the high-silicon steel sheets obtained as described above. In addition, the punching workability (number of cracks generated when punching work was performed) and magnetic properties (iron loss (W1/10k) and magnetic flux density (B50)) of the sample of each of the high-silicon steel sheets obtained as described above were investigated.

The grain-boundary oxygen concentration was determined by using an Auger electron spectrometer while the sample was fractured in a vacuum vessel whose vacuum degree was maintained to be 10' Pa or lower.

In determining the texture in the surface layer of each of the steel sheets, seven planes having Miller indices of {110}, {200}, {211}, {310}, {222}, {321}, and {411} were observed by using an X-ray diffraction method with a Mo-Kα ray by using RINT-2200 manufactured by Rigaku Corporation.

The punching workability of each of the steel sheets was evaluated on the basis of the number of cracks generated by observing shear surfaces by using a microscope at a magnification of 50 times. Instances when the number of cracks was 5 or less was judged as good, and instances when the number of cracks was 2 or less was judged as very good.

Regarding the magnetic properties, iron loss (W1/10k) and magnetic flux density (B50) were determined by using the method in accordance with JIS C 2550 (Epstein testing method).

The obtained results are given in Table 1.

TABLE 1

| | Slab Chemical (mass %) | | | | | | | | Product Chemical Composition (mass %)* | | Roll Ra |
|---|---|---|---|---|---|---|---|---|---|---|---|
| No. | C | Si | Mn | P | Al | O | N | S | Average Si | ΔSi | (μm) |
| 1 | 0.0019 | 3.12 | 0.12 | 0.003 | 0.001 | 0.0016 | 0.0018 | 0.0021 | 6.49 | <0.1 | 0.15 |
| 2 | 0.0023 | 3.08 | 0.15 | 0.004 | 0.001 | 0.0013 | 0.0015 | 0.0013 | 6.51 | <0.1 | 0.15 |
| 3 | 0.0029 | 3.22 | 0.18 | 0.005 | 0.001 | 0.0017 | 0.0021 | 0.0015 | 6.50 | <0.1 | 0.16 |
| 4 | 0.0018 | 3.14 | 0.11 | 0.005 | 0.001 | 0.0018 | 0.0019 | 0.0016 | 5.92 | <0.1 | 0.15 |
| 5 | 0.0023 | 3.13 | 0.21 | 0.013 | 0.001 | 0.0015 | 0.0014 | 0.0012 | 6.51 | <0.1 | 0.14 |
| 6 | 0.0022 | 3.20 | 0.16 | 0.003 | 0.001 | 0.0019 | 0.0009 | 0.0018 | 6.48 | <0.1 | 0.15 |
| 7 | 0.0018 | 3.19 | 0.19 | 0.004 | 0.001 | 0.0021 | 0.0023 | 0.0013 | 6.53 | <0.1 | 0.51 |
| 8 | 0.0017 | 3.16 | 0.18 | 0.006 | 0.001 | 0.0017 | 0.0016 | 0.0014 | 6.53 | <0.1 | 0.46 |
| 9 | 0.0015 | 3.11 | 0.19 | 0.004 | 0.001 | 0.0018 | 0.0013 | 0.0020 | 6.47 | <0.1 | 0.23 |
| 10 | 0.0017 | 3.26 | 0.13 | 0.005 | 0.001 | 0.0020 | 0.0011 | 0.0015 | 6.48 | <0.1 | 0.09 |
| 11 | 0.0017 | 3.26 | 0.13 | 0.005 | 0.001 | 0.0020 | 0.0011 | 0.0014 | 6.48 | <0.1 | 0.09 |
| 12 | 0.0021 | 3.06 | 0.16 | 0.008 | 0.001 | 0.0017 | 0.0015 | 0.0012 | 4.32 | <0.1 | 0.13 |
| 13 | 0.0024 | 3.36 | 0.12 | 0.003 | 0.001 | 0.0019 | 0.0018 | 0.0016 | 7.21 | <0.1 | 0.16 |
| 14 | 0.0021 | 3.18 | 1.09 | 0.005 | 0.001 | 0.0025 | 0.0021 | 0.0013 | 6.53 | <0.1 | 0.13 |
| 15 | 0.0022 | 3.26 | 0.11 | 0.006 | 0.31 | 0.0015 | 0.0022 | 0.0014 | 6.49 | <0.1 | 0.15 |
| 16 | 0.0012 | 3.22 | 0.15 | 0.003 | 1.05 | 0.0016 | 0.0013 | 0.0014 | 6.47 | <0.1 | 0.15 |
| 17 | 0.0016 | 3.17 | 0.17 | 0.004 | 0.001 | 0.0113 | 0.0016 | 0.0012 | 6.52 | <0.1 | 0.14 |
| 18 | 0.0015 | 3.25 | 0.15 | 0.005 | 0.001 | 0.0018 | 0.0110 | 0.0019 | 6.49 | <0.1 | 0.14 |
| 19 | 0.0015 | 3.09 | 0.14 | 0.006 | 0.001 | 0.0024 | 0.0015 | 0.0016 | 6.52 | <0.1 | 0.31 |
| 20 | 0.0015 | 3.09 | 0.14 | 0.006 | 0.001 | 0.0024 | 0.0015 | 0.0022 | 6.53 | <0.1 | 0.31 |
| 21 | 0.0015 | 3.09 | 0.14 | 0.006 | 0.001 | 0.0024 | 0.0015 | 0.0016 | 6.52 | <0.1 | 0.32 |
| 22 | 0.0015 | 3.09 | 0.14 | 0.006 | 0.001 | 0.0024 | 0.0015 | 0.0018 | 6.54 | <0.1 | 0.32 |
| 23 | 0.0018 | 3.26 | 0.18 | 0.005 | 0.001 | 0.0016 | 0.0018 | 0.0019 | 5.26 | 3.25 | 0.16 |
| 24 | 0.0018 | 3.26 | 0.18 | 0.005 | 0.001 | 0.0016 | 0.0016 | 0.0015 | 5.23 | 1.56 | 0.14 |
| 25 | 0.0018 | 3.26 | 0.18 | 0.005 | 0.001 | 0.0016 | 0.0016 | 0.0017 | 5.23 | 1.56 | 0.14(*1) |
| 26 | 0.0018 | 3.26 | 0.18 | 0.005 | 0.001 | 0.0016 | 0.0016 | 0.0017 | 5.23 | 1.56 | 0.14(*2) |
| 27 | 0.0018 | 3.26 | 0.18 | 0.005 | 0.001 | 0.0016 | 0.0016 | 0.0017 | 5.23 | 1.56 | 0.14(*3) |
| 28 | 0.0016 | 3.15 | 0.11 | 0.006 | 0.001 | 0.0018 | 0.0014 | 0.0112 | 6.51 | <0.1 | 0.15 |

| No. | Aging Treatment | Dew point (° C.) | Grain-Boundary Oxygen Content (at %) | P(211) (%) | Number of Cracks (number) | W1/10k (W/kg) | B50 (T) | Note |
|---|---|---|---|---|---|---|---|---|
| 1 | Undone | 0 | 39 | 28 | 11 | 8.5 | 1.49 | Comparative Example |
| 2 | Undone | −10 | 36 | 29 | 8 | 8.4 | 1.49 | Comparative Example |
| 3 | Undone | −20 | 24 | 27 | 2 | 8.3 | 1.49 | Example |
| 4 | Undone | −20 | 19 | 29 | 1 | 8.5 | 1.50 | Example |
| 5 | Undone | −20 | 29 | 30 | 4 | 7.9 | 1.49 | Example |
| 6 | Undone | −40 | 5 | 27 | 1 | 8.3 | 1.49 | Example |
| 7 | Undone | −40 | 5 | 13 | 13 | 8.1 | 1.52 | Comparative Example |

TABLE 1-continued

| | | | | | | | | |
|---|---|---|---|---|---|---|---|---|
| 8 | Undone | −40 | 5 | 18 | 5 | 8.2 | 1.52 | Example |
| 9 | Undone | −40 | 5 | 22 | 2 | 8.0 | 1.50 | Example |
| 10 | Undone | −40 | 5 | 42 | 1 | 7.9 | 1.47 | Example |
| 11 | 120° C. × 6 min | −40 | 5 | 56 | 0 | 7.9 | 1.46 | Example |
| 12 | Undone | −40 | 5 | 35 | 1 | 13.5 | 1.60 | Comparative Example |
| 13 | Undone | −40 | 5 | 29 | 9 | 7.6 | 1.42 | Comparative Example |
| 14 | Undone | −40 | 5 | 31 | 3 | 8.1 | 1.42 | Comparative Example |
| 15 | Undone | −40 | 5 | 27 | 2 | 7.9 | 1.48 | Example |
| 16 | Undone | −40 | 5 | 28 | 5 | 8.0 | 1.41 | Comparative Example |
| 17 | Undone | −40 | 5 | 30 | 12 | 8.7 | 1.46 | Comparative Example |
| 18 | Undone | −40 | 5 | 28 | 11 | 8.6 | 1.45 | Comparative Example |
| 19 | Undone | −40 | 5 | 19 | 5 | 8.3 | 1.51 | Example |
| 20 | 45° C. × 6 min | −40 | 5 | 19 | 5 | 8.2 | 1.50 | Example |
| 21 | 60° C. × 6 min | −40 | 5 | 26 | 2 | 8.1 | 1.49 | Example |
| 22 | 120° C. × 6 min | −40 | 5 | 45 | 1 | 8.1 | 1.47 | Example |
| 23 | Undone | −40 | 5 | 26 | 1 | 6.8 | 1.55 | Example |
| 24 | Undone | −40 | 5 | 28 | 1 | 7.3 | 1.55 | Example |
| 25 | Undone | −40 | 5 | 17 | 5 | 7.6 | 1.56 | Example |
| 26 | Undone | −40 | 5 | 21 | 3 | 7.5 | 1.55 | Example |
| 27 | Undone | −40 | 5 | 24 | 2 | 7.4 | 1.55 | Example |
| 28 | Undone | −40 | 5 | 26 | 10 | 8.9 | 1.46 | Comparative Example |

*the same as the slab chemical composition with the exception of Si (*1)Ra was 0.14 μm for the 1st pass and more than 0.5 μm for other passes among 8 passes.

(*2)Ra was 0.14 μm for the 1st and 2nd passes and more than 0.5 μm for other passes among 8 passes.

(*3)Ra was 0.14 μm for the 1st, 2nd, and 3rd passes and more than 0.5 μm for other passes among 8 passes.

As Table 1 indicates, the high-silicon steel sheets (our examples) that satisfied our conditions were excellent in terms of magnetic properties and capable of preventing cracking from occurring when punching work was performed. On the other hand, the comparative examples were poor in terms of at least one of punching workability and magnetic properties.

The invention claimed is:

1. A high-silicon steel sheet having a chemical composition containing, by mass %, C: 0.02% or less, P: 0.02% or less, Si: 4.5% or more and 7.0% or less, Mn: 0.01% or more and 1.0% or less, Al: 1.0% or less, O: 0.01% or less, N: 0.01% or less, and the balance being Fe and inevitable impurities, a grain-boundary oxygen concentration comprising oxygen concentration with respect to chemical elements segregated at grain boundaries of 30 at % or less, and a microstructure in which a degree of integration P(211) of a {211}-plane of α-Fe on a surface of the steel sheet is 15% or more, wherein, a degree of integration P(hkl) of each crystal plane is defined by equation (1) on a basis of integrated intensities of various peaks obtained by using an X-ray diffraction method:

$$P(211)=p(211)/S\times 100(\%) \quad (1)$$

wherein $$S=p(110)/100+p(200)/14.93+p(211)/25.88+p(310)/7.68+p(222)/1.59+p(321)/6.27+p(411)/1.55, \text{ and}$$

wherein p(hkl): integrated intensity of a peak of X-ray diffraction of an {hkl}-plane.

2. The high-silicon steel sheet according to claim 1, wherein the chemical composition further contains, by mass %, S: 0.010% or less.

3. The high-silicon steel sheet according to claim 1, wherein the degree of integration P(211) is 20% or more.

4. The high-silicon steel sheet according to claim 2, wherein the degree of integration P(211) is 20% or more.

5. The high-silicon steel sheet according to claim 1, wherein a difference in Si concentration ΔSi between a surface layer of the steel sheet and a central portion in a thickness direction of the steel sheet is 0.1% or more.

6. The high-silicon steel sheet according to claim 2, wherein a difference in Si concentration ΔSi between a surface layer of the steel sheet and a central portion in a thickness direction of the steel sheet is 0.1% or more.

7. The high-silicon steel sheet according to claim 3, wherein a difference in Si concentration ΔSi between a surface layer of the steel sheet and a central portion in a thickness direction of the steel sheet is 0.1% or more.

8. The high-silicon steel sheet according to claim 4, wherein a difference in Si concentration ΔSi between a surface layer of the steel sheet and a central portion in a thickness direction of the steel sheet is 0.1% or more.

9. A method of manufacturing the high-silicon steel sheet according to claim 1, comprising:

performing hot rolling on a steel slab having a chemical composition containing, by mass %, C: 0.02% or less, P: 0.02% or less, Si: 5.5% or less, Mn: 0.01% or more and 1.0% or less, Al: 1.0% or less, O: 0.01% or less, N: 0.01% or less, and the balance being Fe and inevitable impurities, optionally performing hot-rolled-sheet annealing, performing cold rolling once, or more than once with a process annealing interposed between periods in which cold rolling is performed under a condition that at least one pass of final cold rolling is performed with rolls having an Ra of 0.5 μm or less, and performing finish annealing including a gas-phase siliconizing treatment.

10. The method according to claim 9, wherein the chemical composition further contains, by mass %, S: 0.010% or less.

11. The method according to claim 9, further comprising an aging treatment performed at least once between passes of the final cold rolling at a temperature of 50° C. or higher for 5 minutes or more.

12. The method according to claim 10, further comprising an aging treatment performed at least once between passes of the final cold rolling at a temperature of 50° C. or higher for 5 minutes or more.

13. A method of manufacturing the high-silicon steel sheet according to claim 3, comprising:

performing hot rolling on a steel slab having a chemical composition containing, by mass %, C: 0.02% or less, P: 0.02% or less, Si: 5.5% or less, Mn: 0.01% or more and 1.0% or less, Al: 1.0% or less, O: 0.01% or less, N: 0.01% or less, and the balance being Fe and inevitable impurities, optionally performing hot-rolled-sheet annealing, performing cold rolling once, or more than once with a process annealing interposed between periods in which cold rolling is performed under a condition that at least one pass of final cold rolling is performed with rolls having an Ra of 0.5 μm or less, and performing finish annealing including a gas-phase siliconizing treatment.

14. The method according to claim 13, wherein the chemical composition further contains, by mass %, S: 0.010% or less.

15. The method according to claim 13, further comprising an aging treatment performed at least once between passes of the final cold rolling at a temperature of 50° C. or higher for 5 minutes or more.

16. The method according to claim 14, further comprising an aging treatment performed at least once between passes of the final cold rolling at a temperature of 50° C. or higher for 5 minutes or more.

17. A method of manufacturing the high-silicon steel sheet according to claim 5, comprising:

performing hot rolling on a steel slab having a chemical composition containing, by mass %, C: 0.02% or less, P: 0.02% or less, Si: 5.5% or less, Mn: 0.01% or more and 1.0% or less, Al: 1.0% or less, O: 0.01% or less, N: 0.01% or less, and the balance being Fe and inevitable impurities, optionally performing hot-rolled-sheet annealing, performing cold rolling once, or more than once with a process annealing interposed between periods in which cold rolling is performed under a condition that at least one pass of final cold rolling is performed with rolls having an Ra of 0.5 μm or less, and performing finish annealing including a gas-phase siliconizing treatment.

18. The method according to claim 17, wherein the chemical composition further contains, by mass %, S: 0.010% or less.

19. The method according to claim 17, further comprising an aging treatment performed at least once between passes of the final cold rolling at a temperature of 50° C. or higher for 5 minutes or more.

20. The method according to claim 18, further comprising an aging treatment performed at least once between passes of the final cold rolling at a temperature of 50° C. or higher for 5 minutes or more.

* * * * *